US005812056A

United States Patent [19]

Law

[11] Patent Number: 5,812,056

[45] Date of Patent: Sep. 22, 1998

[54] CHILD LOCATING AND MONITORING DEVICE

[75] Inventor: Wilson Law, Kowloon, Hong Kong

[73] Assignee: Golden Eagle Electronics Manufactory Ltd., Tsuen Wan, Hong Kong

[21] Appl. No.: 854,082

[22] Filed: May 9, 1997

[51] Int. Cl.[6] ..... G08B 1/08

[52] U.S. Cl. ..... 340/539; 340/571; 340/573; 340/825.49

[58] Field of Search ..... 340/539, 571–573, 340/825.49, 825.36, 825.72, 825.69, 696, 531; 342/357, 450, 457, 126, 127; 455/9, 54, 67, 95, 100; 367/197–199, 93, 94

[56] References Cited

U.S. PATENT DOCUMENTS

| | | | |
|---|---|---|---|
| 4,598,272 | 7/1986 | Cox | 340/539 |
| 4,785,291 | 11/1988 | Hawthorne | 340/573 |
| 4,899,135 | 2/1990 | Ghahariran | 340/573 |
| 4,973,944 | 11/1990 | Maletta | 340/568 |
| 5,021,794 | 6/1991 | Lawrence | 342/457 |
| 5,115,223 | 5/1992 | Moody | 340/573 |
| 5,119,072 | 6/1992 | Hemingway | 340/573 |
| 5,121,096 | 6/1992 | Moore et al. | 340/326 |
| 5,289,163 | 2/1994 | Perez et al. | 340/539 |
| 5,337,041 | 8/1994 | Friedman | 340/573 |
| 5,357,254 | 10/1994 | Kah, Jr. | 342/42 |
| 5,510,771 | 4/1996 | Marshall | 340/573 |
| 5,650,770 | 7/1997 | Schlager et al. | 340/573 |

*Primary Examiner*—Jeffery A. Hofsass
*Assistant Examiner*—Daryl Pope
*Attorney, Agent, or Firm*—Cohen, Pontani, Lieberman, Pavane

[57] ABSTRACT

A wireless child monitoring and location device consisting of a device pair having a guardian unit and a child unit, both of which are operable in the 900 MHz frequency band and in the presence of other wireless devices transmitting and receiving within the same frequency band. The guardian unit is able to detect when a child strays beyond a preset distance or when the child is simply out of sight, e.g. around a corner but within the preset distance. The child and guardian units execute a "handshake" sequence during power-up to select a unique digital operating address or channel and establish a time marker used to synchronize transmission between the units. This allows each child/guardian pair to operate in the presence of similarly configured devices without the undesirable possibility of interference among the devices. The child and guardian units are capable of electronically reconnecting if communication between the units is interrupted. The guardian unit is capable of communicating a preset delay period to the child unit to offset the start point of the time marker to avoid jamming from other similarly configured units operating in the vicinity.

10 Claims, 7 Drawing Sheets

100
10
12
FILTER
14
60
16
18
FILTER
20
22
80
24
30
MICROPROCESSOR
32
40
46
42
44
50
52
FILTER
54
56
62
64
66
68
70
72

200
210
212
FILTER
214
216
260
218
FILTER
220
222
280
224
272
244
232
234
230
MICROPROCESSOR
236
240
246
248
250
252
FILTER
254
256
262
266
268
238
270
258
INDICATOR
242

BAT1 3-9V
K1
B+
V+
IC1 7201
C8 100u
LED1
R3 332
632
636
634
D1 4148
R10 512
BZ1
46
R14 101
R11 102
40
Q5 1602
R16 332
614
612
R18 104
Q4 1602
72
62,68
R13 203
R5 104
U2 TMP47C101
C5 403
CR1 4MHz
C1 30
C16 30
C17 10u
30
D2 4148
R9 104
R8 104
U1
R15
S1
32
R12
R19
R20
R23 203
Q7 1602
R24 104
R27 392
64
66
R29 104
R28 105
Q6 1702
618
616
U1:B
C30 68
Q10 BFR92
620
L9 2T2.5D
C39 6.8
C37 102
ANT2
50
L10 0.5T
626
C44 3.9
628
624
52
54
R34 151
R30 103
R39 272
Q8 402
42
C43 0.5
C36 403
R31 123
R33 103
C33 104
C35 682
MIC1 44
C31 47uF
C26 102
R25 104
R26 821
C34 0.5
C38 1
56
C42 5.6
L8 4TID
C29
C28 101
Q9 BFR92
630
R36 471
SAW1 RPI285
U4:E
R32
C32 0.5
R1 101
R7 103
L2 3.5T D-4.0 WT:04
Q1 BFR92
C3 102
R4 100
16
C2 102
C7 102
C8
C10 3.9
C15
4D1T
L4
R17 153
C21 471
C1 102
C9 6.8
L3 4D3T
Q2 BFR92
R22 821
C22 471
R2 102
604
C4 102
C13 3.9
R21 223
L1 4D2T
C12 6.8
Q3 602
L5 4D1T
14
R6 563
C18 6.8
C20 1.5
L6
12
C14 6.8
L7
C19 1.5
ANT1
10
2.5D2T WT:0.6
C3 102
20
C27 4.7u
606
C41 272
22
F1 10.7MHz
C24 102
C25 47
U4 314
U3
18
R30 106
R35 682
C40 47u
LM324 U1:C
608
24

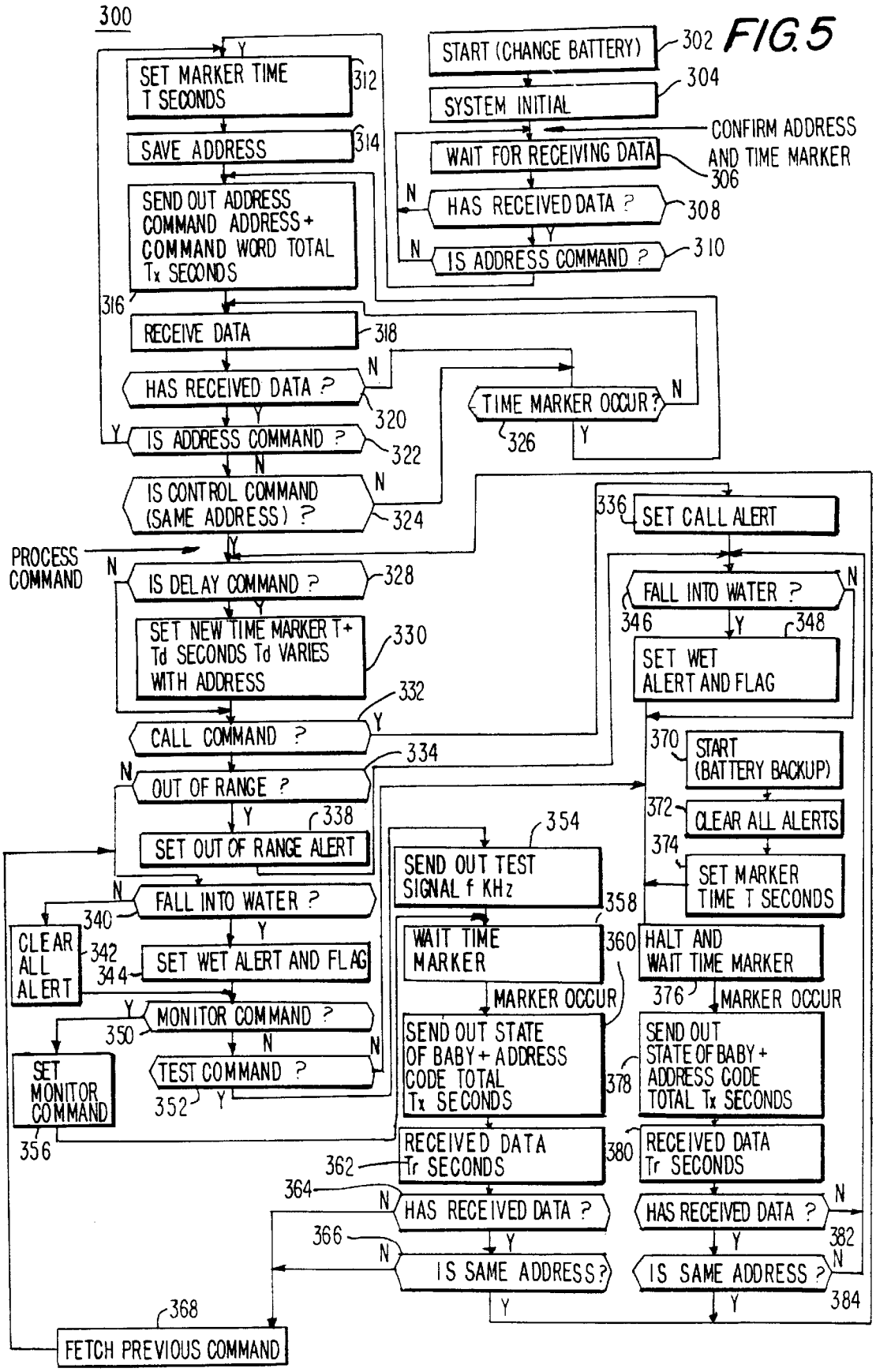
300
FIG. 5
START (CHANGE BATTERY)
302
SYSTEM INITIAL
304
CONFIRM ADDRESS AND TIME MARKER
WAIT FOR RECEIVING DATA
306
HAS RECEIVED DATA ?
308
IS ADDRESS COMMAND ?
310
SET MARKER TIME T SECONDS
312
SAVE ADDRESS
314
SEND OUT ADDRESS COMMAND ADDRESS + COMMAND WORD TOTAL Tx SECONDS
316
RECEIVE DATA
318
HAS RECEIVED DATA ?
320
IS ADDRESS COMMAND ?
322
IS CONTROL COMMAND (SAME ADDRESS) ?
324
TIME MARKER OCCUR ?
326
PROCESS COMMAND
IS DELAY COMMAND ?
328
SET NEW TIME MARKER T + Td SECONDS Td VARIES WITH ADDRESS
330
CALL COMMAND ?
332
OUT OF RANGE ?
334
SET OUT OF RANGE ALERT
338
FALL INTO WATER ?
340
CLEAR ALL ALERT
342
SET WET ALERT AND FLAG
344
MONITOR COMMAND ?
350
SET MONITOR COMMAND
356
TEST COMMAND ?
352
SEND OUT TEST SIGNAL f KHz
354
WAIT TIME MARKER
358
MARKER OCCUR
SEND OUT STATE OF BABY + ADDRESS CODE TOTAL Tx SECONDS
360
RECEIVED DATA Tr SECONDS
362
HAS RECEIVED DATA ?
364
IS SAME ADDRESS ?
366
FETCH PREVIOUS COMMAND
368
SET CALL ALERT
336
FALL INTO WATER ?
346
SET WET ALERT AND FLAG
348
START (BATTERY BACKUP)
370
CLEAR ALL ALERTS
372
SET MARKER TIME T SECONDS
374
HALT AND WAIT TIME MARKER
376
MARKER OCCUR
SEND OUT STATE OF BABY + ADDRESS CODE TOTAL Tx SECONDS
378
RECEIVED DATA Tr SECONDS
380
HAS RECEIVED DATA ?
382
IS SAME ADDRESS ?
384

CHILD LOCATING AND MONITORING DEVICE

BACKGROUND OF THE INVENTION

1. Field of the Invention

This invention relates to wireless electronic devices and more particularly, to a device specifically designed for monitoring the location of a child.

2. Description of the Related Art

Children are naturally curious and often restless. When subjected to some adult activities such as, for example, shopping, children have a tendency to wander. In a matter of seconds, while the parent or guardian is distracted, a child can move quickly out of sight and become lost. In most instances, the child is nearby but merely out of sight. In some cases, though, the child may be fall into danger such as by abduction.

With the commercial availability of the 900 MHz communication band, wireless devices operating in this band have proliferated. Examples include cordless telephones, wireless headphones for stereo and television, and wireless child monitoring and locating devices. In the last category, one can easily envision a situation in a shopping mall, for example, where more than one such wireless child monitoring device is in use within close proximity of another similar device. In such a situation, interference among the devices is possible—the undesirable result being that the units will be rendered useless.

Previous inventions for wireless child locating and monitoring devices have been directed toward improvements in monitoring the distance between the guardian and child units.

For example, U.S. Pat. No. 5,357,254 to Kah, Jr. discloses a radio transmitter monitoring device which is used to determine the range and direction between two or more relative moving objects, i.e. a child and a guardian. A child transceiver is affixed to a child and a guardian transceiver is carried by the guardian. A maximum range between the two transceivers is set and if the range is exceeded, an alarm is sounded indicating to the guardian that the child has moved out of range.

In another example, U.S. Pat. No. 5,289,163 to Perez et al. discloses a locator device consisting of two separate transceiver units. The child transceiver unit generates a signal which is received by the guardian unit. If the radio frequency carrier of the signal generated by the child transceiver unit becomes weak as a result of the child receiver unit exceeding a certain distance, an alarm tone is sounded on the guardian transceiver unit to alert the guardian that the child has wandered off. The guardian transceiver unit also has a direction indicator function to assist in locating the child.

In still another example, U.S. Pat. No. 5,119,072 to Hemingway describes a pair of transceiver units wherein a desired distance or range is preset and an alarm is sounded when the distance between the transceiver units is exceeded. The alarm circuit is operated by measuring the field strength of the carrier component of the signal generated by the child transceiver unit. When the strength of the carrier component falls below a threshold value, an alarm on the guardian transceiver unit is sounded. This patent also discloses an alarm condition when the child transceiver is removed from the child.

In a further example, U.S. Pat. No. 4,899,135 to Ghaharriiran discloses a device having two transceivers which will sound an alarm when a preset distance between them is exceeded. This patent also discloses a feature wherein an alarm is sounded when the child transceiver is immersed in water or when the child transceiver is removed from the child.

Alternatively, improvements have been made in wireless child monitoring devices used for simple one-way communication. For example, U.S. Pat. No. 5,337,041 to Friedman discloses two transceiver units, one carried by the guardian and the other carried by the child. The guardian unit is used to trigger an alarm on the child unit when the guardian wants the child to return to the guardian.

Even with the existence of the foregoing known devices, there is, nonetheless, a need for a wireless child monitoring and locating device (e.g. a unit pair having a guardian unit and a child unit) which is operable in the presence of other similarly configured or even identical devices. Such a device will be capable of detecting the presence of interfering proximate devices and remotely and electronically reconfiguring the unit pair (guardian and child units) to avoid interference from the other devices and possible disfunction from interference.

SUMMARY OF THE INVENTION

The present invention relates to a wireless child monitoring and location device consisting of a device pair having a guardian unit and a child unit, both of which are operable in the 900 MHz frequency band and in the presence of other similarly configured wireless devices. Operation in the 900 MHz band allows the present invention to use a relatively short internally mounted quarter-wave antenna and requires a substantially unobstructed line-of-sight alignment between the guardian and child units for continued operation. As a result, the guardian unit is able to detect if a child strays beyond a preset distance or if the child is simply out of sight, e.g. around a corner but within the preset distance.

In a preferred embodiment of the present invention, the child and guardian units execute a "handshake" sequence during power-up to select a unique digital operating address or channel and establish a time marker used to synchronize transmission between the units. This allows each child/guardian unit pair to operate in the presence of similarly configured devices without the undesirable possibility of interference among the devices.

In another preferred embodiment the present invention provides child and guardian units capable of remotely establishing an operating address and time marker. If the guardian unit detects other similarly configured units operating in the vicinity of a child/guardian pair or if the guardian unit does not receive a communication from its corresponding child unit for a predetermined number of occurrences of its time marker, the guardian is able to establish a new operating address and/or time marker with its corresponding child unit to avoid possible interference or jamming with other similar units operating in the vicinity.

In still another embodiment of the present invention, the guardian unit is capable of communicating a preset delay period to the child unit to offset the start point of the time marker. Thus, if the guardian unit detects that other units operating in the vicinity are interrupting the communication between the guardian/child unit pair, the guardian unit may electronically and remotely shift the starting location of the time marker by the delay period. The length of the delay period is preferably greater than the length of the data transmission.

In another embodiment, the child and guardian units of the present invention each have a single oscillator configured as transceivers, i.e. operable as both a transmitter and receiver.

In yet another embodiment of the present invention, the wireless child monitoring and locating device includes a feature that activates an alarm when the child unit is removed from the child, e.g. in the event the child is abducted, etc. In this event, both the guardian and child units will sound an alarm to alert the public. The same feature enables the child unit to signal the guardian unit when the former is submerged in liquid.

In a further embodiment, the wireless child monitoring and locating device includes a guardian unit configurable to set a maximum allowable distance between the child and guardian units before an alarm is sounded. For example, when the child travels beyond the maximum pre-set distance, the alarm will activate on the guardian unit, thus alerting the guardian that the child has wandered off and allowing the guardian to signal the child to return by transmitting a different tone signal to the child unit. This feature is also activated if the child move out of the line of sight of the guardian unit. In other words, even if the child is within the maximum separation distance, the guardian alarm will activate if the child is no longer visible by the guardian, e.g. if the child moves around a corner or other obstacle or obstruction. In a still further embodiment, the guardian unit may activate a microphone provided in the child unit to listen to the child and the surrounding sounds.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views:

FIG. 5 is a flowchart of the operation of the child unit of FIG. 1;

DETAILED DESCRIPTION OF THE PRESENTLY PREFERRED EMBODIMENTS

The present invention provides a novel and advantageous device for locating and monitoring the position of a person, preferably a child, with respect to another person, preferably a guardian. Wearable child and guardian units are provided that communicate wirelessly with each other and that are not impeded by solid objects, i.e. line-of-sight orientation between the units is not required for intended operation. After a child/guardian unit pair is initially configured, the child unit continuously transmits to the guardian unit—the guardian unit being configured to detect when such transmissions do not occur. The guardian unit is additionally configured to monitor whether the child unit is immersed in water, or if the unit has been removed from the child. In addition, the guardian unit may also listen to the ambient sounds about the child, which is especially useful if the guardian suspects the child may be in danger.

In addition to the above, the guardian unit can control the operation of the child unit, at least to some degree, insofar as the aforementioned listening capability is concerned by remotely activating a microphone included on the child unit. The guardian unit can also remotely activate a buzzer or speaker on the child unit to annunciate an audible command or alarm, in the event that the guardian wishes to notify the child that he/she has strayed too far from the guardian. A particularly advantageous and novel feature enables the guardian unit to detect the presence of other similarly configured devices and to remotely reconfigure the child unit so as to avoid possible communication interference among the units.

The present invention accordingly provides a user wearable pair of devices that communicate wirelessly between each and that are able to exclude communications from other wireless devices not intended for these particular devices. The present invention further advantageously provides a pair of wearable devices that are virtually immune from interference from other similarly configured devices operating in the same area. The devices of the present invention are also able to remotely and wirelessly reconfigure to maintain communication in the presence of various interfering conditions.

Figure 1:
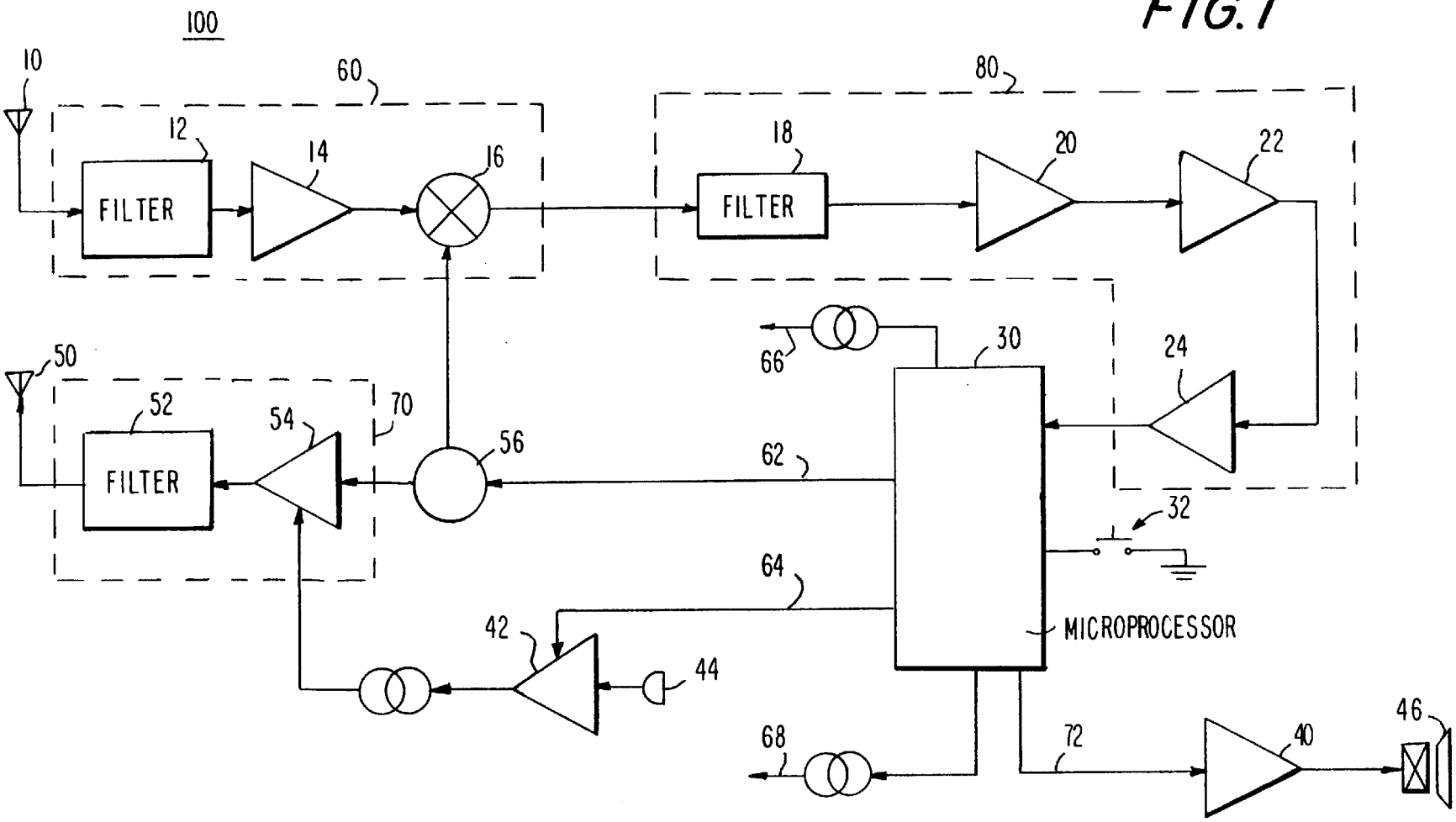
FIG. 1 is a block diagram of the child unit of a child locating and monitoring device configured in accordance with the present invention.
Figure 2:
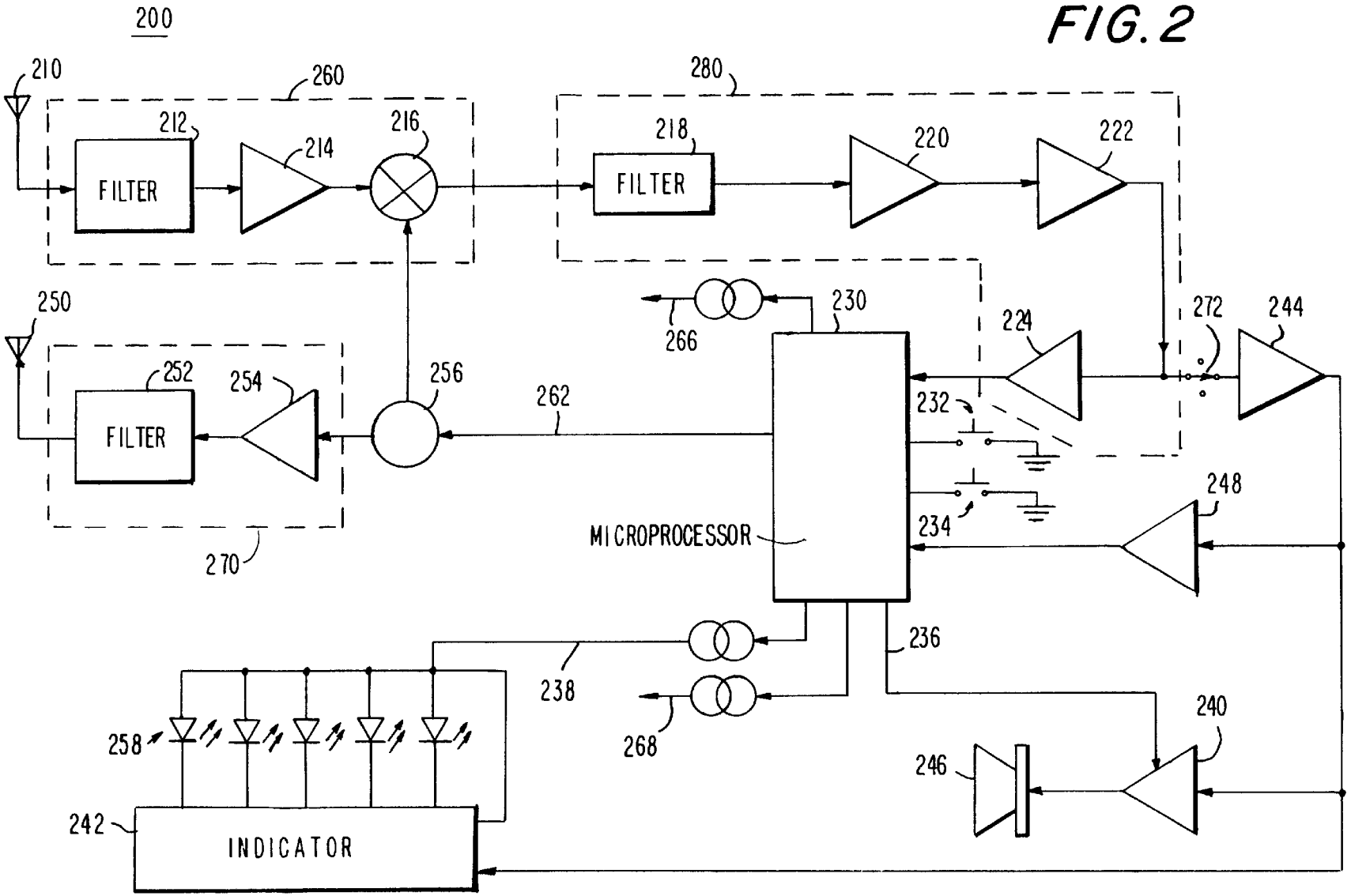
FIG. 2 is a block diagram of the guardian unit of a child locating and monitoring device configured in accordance with the present invention.

Referring now to the drawings in detail, FIGS. 1 and 2 depict block diagrams of a child unit 100 (FIG. 1) and a guardian unit 200 (FIG. 2) of the present invention. Both the child unit 100 and guardian unit 200 include first and second stage input conditioning circuits, 60, 260 and 80, 280, respectively, a microprocessor 30, 230 and an output conditioning circuit 70, 270. The following discussion of the functionality and operation of these circuits is directed to the child unit 100 with the understanding that such discussion applies equally to the circuits of the guardian unit 200. Differences between the two units will be identified, where applicable.

The child unit 100 is configured for two-way wireless communication with a guardian unit 200 in the 900 MHz frequency band, i.e. between approximately 902 MHz and 928 MHz. The input conditioning circuits 60, 80 generally filter, amplify and downconvert the received signal from 900 MHz to an intermediate frequency (IF) of approximately 10.7 MHz. The output conditioning circuit 70 generally amplifies and filters the transmitted signal. The microprocessor 30 executes the complex firmware provided in the unit.

Figure 3:
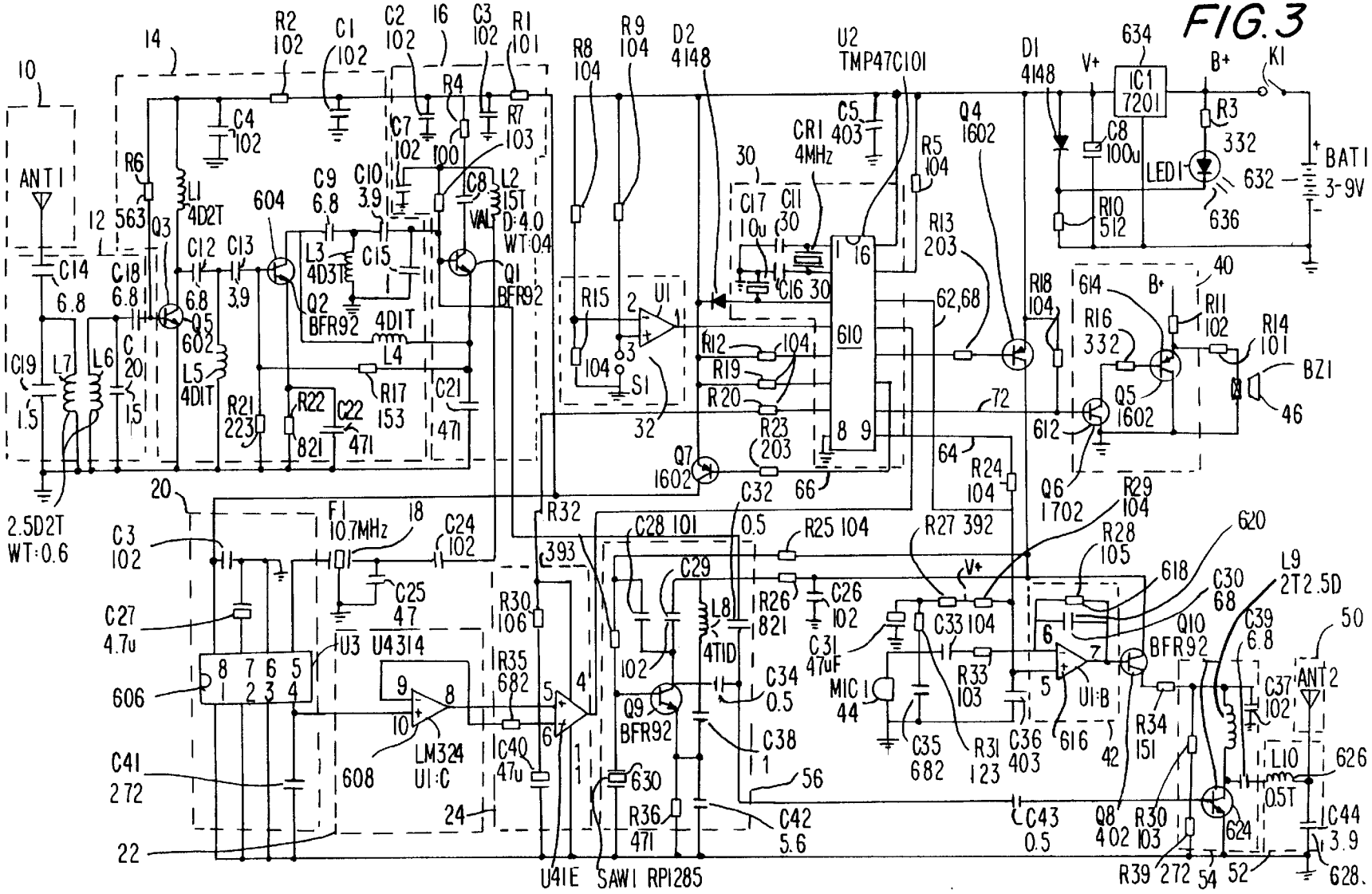
FIG. 3 is a schematic diagram of the presently preferred circuitry incorporated in the child unit of FIG. 1.

With continued reference to FIG. 1 and additional reference to FIG. 3, the child unit 100 of the present invention is configured as a transceiver, i.e. as both a transmitter and receiver, and includes an internal quarter-wave receiving antenna 10 and an internal quarter-wave transmitting antenna 50. The receiving antenna 10 receives amplitude modulated (AM) radio frequency (RF) signals from the guardian unit 200 and is connected to the first stage conditioning circuit 60 which includes a band-pass filter 12 tuned for operation in the 900 MHz frequency band. In a preferred embodiment, the filter 12 is tuned to pass signals received at approximately 901 MHz while the filter 212 of the guardian unit 200 is tuned to pass signals received at approximately 910 MHz. Conversely, the output filter 52 of the child unit 100 is tuned to pass transmit signals at approximately 910 MHz and the filter 252 of the guardian unit 200 is tuned to pass transmit signals at approximately 901 MHz. The band-pass filter 12 removes unwanted or undesirable sideband signals from the incoming signal. The output of the band-pass filter 12 is amplified by a two-stage amplifier 14 which includes a pair of cascaded NPN transistors 602, 604 and which is operable in the 900 MHz frequency band.

The output of amplifier 14 is connected to a mixer 16 which also receives input from a local oscillator 56 which includes a surface acoustic wave (SAW) stabilized oscillator 630 tuned to output a fixed frequency of approximately 905.5 MHz. The mixer 216 for the guardian unit 200 is connected to a local oscillator 256 which includes a SAW 730 tuned to output a fixed frequency of approximately 916.4 MHz. Mixer 16 combines the input signal from amplifier 14 and the output from local oscillator 56 in a manner well known to those having ordinary skill in the art to downconvert the frequency of the received signal to an IF of approximately 10.7 MHz.

A second stage conditioning circuit 80 serially follows the first stage conditioning circuit 60 and includes an inexpensive but highly efficient ceramic filter 18 such as, for example, part number SPE10.7MA19 manufactured by Murata. In a preferred embodiment, filter 18 is tuned for high gain and narrow bandwidth. An IF amplifier/AM demodulator 20, which includes an integrated circuit 606, amplifies and demodulates the IF signal output of ceramic filter 18 to extract the analog data component or information from the received signal. A buffer 22 comprising a unitary gain negative feedback operational amplifier (op-amp) 608 is connected between the output of the IF amplifier/AM demodulator 20 and the input of an analog-to-digital (A/D) converter 24 to isolate the latter from the first and second stage conditioning circuits 60, 80. As a final step, the demodulated IF signal output from the buffer 22 is input to the A/D converter 24 to convert the received analog signal to a digital signal usable by the microprocessor 30; the output of the A/D converter 24 being connected as an input to the microprocessor 30.

The microprocessor 30 is a four-bit CMOS-type integrated circuit 610 which performs a variety of complex functions during power-up and normal operation, as described in more detail below. The microprocessor 30 may operate the child unit 100 as a transmitter by supplying a transmit control signal to lead 68. When the child unit 100 is transmitting, the microprocessor 30 encodes and transmits control data and transmits voice signals by activating ON/OFF control lead 62 upon every occurrence of a time marker "T" (as described in more detail below). Specifically, when transmitting, the child unit 100 outputs a pulse having a duration "Tx" of approximately 100 milliseconds (mS) approximately every second on lead 62. Alternatively, the child unit 100 may operate as a receiver when the microprocessor 30 activates a receive control signals on leads 62 and 66. When the child unit 100 is receiving, the microprocessor 30 receives and decodes encoded data from the guardian unit 200. In response to various control data received from the guardian unit 200, the microprocessor 30 may output a variety of alarm tones on lead 72 to an audio amplifier 40 that drives a buzzer or speaker 46.

The microprocessor 30 also performs a power-up handshake function with the microprocessor 230 of the guardian unit 200 to select the operating address and to establish a time marker "T" indicating the start of each transmit and receive period, as described in more detail below. In addition, the microprocessor 30 monitors the status of a wetness switch 32 incorporated in the child unit 100 and generates and transmits an approximately 8 Hz alarm signal to the guardian unit 200 if the wetness switch 32 is closed, i.e. if the child unit 100 is submerged in liquid. Alternatively, the wetness switch 32 can also detect if the child unit 100 has been removed from the child and may signal the guardian unit 200 accordingly.

When the child unit 100 is operating as a receiver, the microprocessor 30 interprets the data received from the guardian unit 200 and generates a tone signal output to audio amplifier 40 to drive buzzer 46 upon receipt of an appropriate command from the guardian unit 200. This occurs, for example, when the guardian unit 200 transmits a "come back" command to the child unit 100 that produces a 4 Hz signal to drive the buzzer 46 when, for example, the child is out of sight or out of range. In addition, upon receipt of a "monitor" command from the guardian unit 200, the microprocessor 30 of the child unit 100 activates a microphone 44 via lead 64 which turns on audio amplifier 42 by activating op-amp 616. This allows the guardian to listen to the child's voice and surrounding sounds. Such a feature is particularly useful if the child is in danger. Resistor 618 and capacitor 620 provide a low-pass filter feedback loop for the op-amp 616 tuned for operation in the audio frequency range, i.e. between approximately 300 Hz to approximately 3.3 kHz. The output from audio amplifier 42 is connected through an isolating NPN transistor 622 to an RF amplifier 54 which also receives input from local oscillator 56. The output from audio amplifier 42 and from local oscillator 56 are combined in the RF amplifier 54, specifically at the base of NPN transistor 624, to generate a modulated RF signal output from RF amplifier 54. This signal is then filtered by filter 52 which includes inductor 626 and capacitor 628 to remove spurious emissions before being output to quarter-wave transmitting antenna 50 for transmission to the guardian unit 200. One-way voice communication from child to guardian is thereby possible by the guardian unit remotely activating the microphone 44 on the child unit 100.

Local oscillator 56 is controlled by microprocessor 30 via an ON/OFF control signal on lead 62 when the child unit 100 is transmitting status information to the guardian unit 200, e.g. when switch 32 closed. The transmitted waveform consists of a 100 mS signal pulse including address and command information transmitted approximately every second, as generated by the local oscillator 56 in response to the ON/OFF control signal from the microprocessor 30 provided on lead 62. The local oscillator 56 outputs the high frequency equivalent of the microprocessor 30 output on lead 62 to the RF amplifier 54. The output of the low pass filter 52 is connected to the transmitting antenna 50. As described briefly above, and in more detail below, the period between transmissions from the child unit 100 to the guardian unit 200 is established during power-up. Specifically, a time marker "T" is established at power-up which sets the starting point of each transmit and receive cycle. The child and guardian units 100, 200 expect to transmit and/or receive data upon every occurrence of time marker "T". If this does not take place, the units attempt to recover and re-synchronize by resetting the time marker "T" which may be remotely reset by the guardian unit 200.

Power to the child unit 100 is supplied by a removable battery 632 and a voltage regulating integrated circuit 634 and is indicated by LED 636. The battery 632 preferably supplies between approximately 3 and 9 volts DC.

Figure 4:
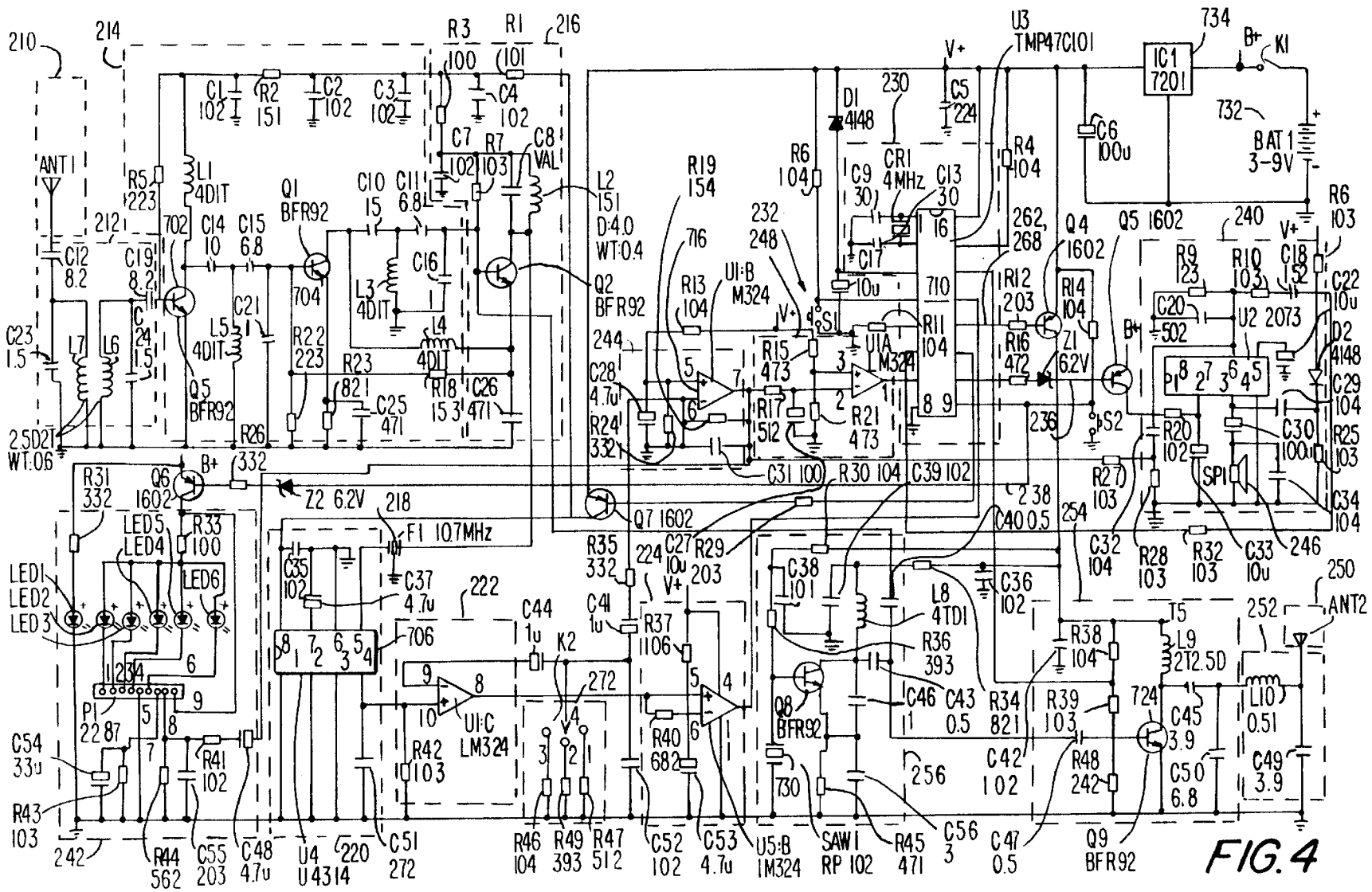
FIG. 4 is a schematic diagram of the presently preferred circuitry incorporated in the guardian unit of FIG. 2.

Referring next to FIGS. 2 and 4, block and schematic diagrams, respectively, of the guardian unit 200 are shown. As indicated above, the guardian unit 200 includes first and second stage input conditioning circuits 260 and 280 and an output conditioning circuit 270 operationally identical to those of the child unit 100. The principal difference being the operating frequency of the local oscillators, as described hereinabove.

In addition to the aforementioned difference, the output of the buffer 222 of the guardian unit 200 is also connected to a range selection switch 272 which permits user selection of the maximum distance between the child and guardian units 100, 200 before an "out of range" alarm will sound. In a preferred embodiment, the maximum distance between the units before an alarm is triggered is 150 feet. The switch 272 is connected to a buffer amplifier 244 which includes an op-amp 716 and which amplifies the demodulated AM input signal and outputs the amplified signal to a DC rectifier 248. The DC rectifier 248 includes a comparator 718 which compares the DC level of the amplified demodulated AM signal with a preset DC voltage and outputs a logic high to the microprocessor 230 if the DC level of the demodulated AM signal exceeds the preset DC threshold in which case the microprocessor 230 activates audio amplifier 240 via lead 236, which is connected to speaker 246. The setting of the switch 272 and the DC level of the received signal provide an indication of the relative distance between the guardian and child units 200, 100.

The output from the buffer amplifier 244 is also connected to an audio amplifier 240 which is controlled by the microprocessor 230 via line 236 to turn on amplifier 240 when the microphone 44 on the child unit 100 is turned on.

A call switch 232 connected to the microprocessor 230 may be depressed by the wearer (e.g. guardian) to send a "come back" command to the child unit 100 which may activate the buzzer 46 thereon. A display switch 234 is also connected to the microprocessor 230 which, when depressed, illuminates a series of light-emitting diodes (LED) 258 in an indicator section 242 via diode control lead 238 to indicate the relative distance between the guardian and child units 200, 100. In a preferred embodiment, six LEDs 258 are provided and the illumination of all indicates close proximity of the child unit 100. Simultaneous depression of switches 232 and 234 will activate the microphone 44 on the child unit 100 and cause the units to enter a "monitor" mode—where ambient sounds about the child unit 100 can be heard. The audio signal received from the child unit 100 is accordingly output to the speaker 246 of the guardian unit 200. The microprocessor 230 is configured to encode and transmit control data by activating ON/OFF control lead 262 in the same manner that control lead 62 is activated (as described hereinabove), and receive and decode encoded data and voice signals from the child unit 100.

Power to the guardian unit 200 is supplied by a removable battery 732 and a voltage regulating integrated circuit 734. The battery 732 preferably supplies between approximately 3 and 9 volts DC.

Referring next to FIG. 5, a flowchart 300 illustrates the operation of the child unit 100. In general, during power-up the guardian unit 200 generates and transmits a sixteen-bit random address to the child unit 100. If the child unit 100 transmits the same address back to the guardian unit 200, the random address is stored in memory in each unit. In a preferred embodiment, a total of 65,534 addresses are possible. Also during power-up, the child and guardian units 100, 200 establish a time marker "T" which synchronizes transmission between the units. Once the initial power-up handshake is completed, the child/guardian pair may be linked by a unique address and time marker "T". The guardian and child units 200, 100 are configured to communicate at every occurrence of time marker "T". Accordingly, failure of the child unit 100 to communicate with the guardian unit 200 for a predetermined number of successive occurrences of the time marker "T" may result in an alarm condition and cause the guardian unit 200 to send a "come back" command to the child unit 100. When the child unit moves back within the preset range, i.e. when the guardian unit 200 receives a transmission with the correct address, the guardian unit 200 may electronically and remotely reset the time marker "T".

With continued reference to FIG. 5, power-up confirmation may be initiated by a user changing the battery 632 at step 302, followed by preliminary configuration (i.e. clearing memory buffers, etc.) at step 304. Alternatively, power-up confirmation may be initiated when the child and guardian units 100, 200 are connected together by conductive strips or other similar electrically conductive means. At step 306, the child unit 100 enters a pause state to wait for data from the guardian unit 200 and periodically checks whether data has arrived at step 308—the child unit 100 looping between steps 308 and 306 until data is received from the guardian unit 200. Once the child unit 100 has received data at step 308 it determines, at step 310, whether the data contains an address command. If the received data is not an address command, the child unit 100 returns to step 306 and continues to loop between steps 308 and 306. If the received data is an address command, the child unit 100 sets a time marker "T" at step 312 that establishes the beginning of the transmit and receive period. Accordingly, the child unit will transmit and/or receive data at every occurrence of "T" and subsequently, the guardian unit 200 will likewise transmit and/or receive at every occurrence of "T".

Thereafter, the child unit 100 stores the address received at step 310 from the guardian unit 200 in memory at step 314. At step 316 the child unit 100 transmits the address received at step 310 and a status command back to the guardian unit 200—the transmission period being approximately 100 mS and designated "Tx" in FIG. 5. The child unit 100 thereafter enters a "receive" mode and awaits a response from the guardian unit 200 at step 318. Having already received address data from the guardian unit 200, the child unit 100 now awaits, at step 320, additional transmission from the guardian unit 200 having a matching address.

If the child unit 100 has not received additional data at step 320 and a time marker "T" has occurred since the last data sent by the child unit 100, the child unit 100 retransmits address and status commands to the guardian unit 200 (at step 316). If a time marker "T" has not occurred at step 326, the child unit 100 continues to wait for a signal from the guardian unit 200.

Returning to step 320, if the child unit 100 has received a signal from the guardian unit 200, the child unit 100 determines, at step 322, whether such data is a new address command—indicating that the guardian unit 200 has detected a collision or interference with another similarly configured unit operating in the same area. If a new address command has been received, i.e. if the guardian unit 200 has generated a new random sixteen-bit address to avoid continued interference with other units, the loop returns to step 312 and a new time marker "T" is set. If the latest transmission from the guardian unit 200 is not a new address command, the child unit 100 determines, at step 324, whether the data is control command data with the previously agreed upon address, i.e. data intended for this particular child unit 100. If the data is not a control command (and not a new address) or if it is a control command but to a different address, the child unit 100 determines whether a time marker "T" has occurred at step 326—the child unit 100 automatically transmitting address and status commands upon every occurrence of "T". If, at step 324, the new data is a command and intended for the child unit 100, i.e. it contains the correct address, the child unit 100 queries whether the new transmission is a delay command, which the guardian unit 200 transmits after it detects an interference or "jam" condition with another similarly configured unit, i.e. a unit having a different address but transmitting at the same time marker "T". If a delay command has been received, the child unit 100 will offset its time marker "T" by a time delay "Td" at step 330 according to the command and time delay data received from the guardian unit at step 328. This effectively establishes a new time marker which is delayed or offset from the previously established time marker by a predetermined delay period. Furthermore, since each random address generated by the guardian unit 200 is associated with a unique time delay, continued collision or interference is advantageously avoided.

If the new data received at step 320 is not a delay command, as determined at step 328, the child unit 100 determines, at step 332, whether the new data is a call command from the guardian unit 200, indicating a "come back" request initiated by depression of the call switch 232 on the guardian unit 200. If the child unit 100 receives a "come back" request, buzzer 46 annunciates an alert signal at step 336. If the command is not a "come back" request, as determined at step 332, the child unit 100 determines whether an "out of range" command has been sent by the guardian unit 200 at step 334 (the maximum distance being set by switch 272 on the guardian unit 200), which causes the buzzer 46 to sound an alarm at step 338. The "out of range" alarm signal is characterized by a low frequency signal, preferably, a 4 Hz signal.

Having either received a "come back" request or an "out of range" alert from the guardian unit 200 and having accordingly sounded an alarm, the child unit 100 next checks, at step 346, whether it is submerged in water, in which case buzzer 46 may sound an alarm at step 348 and an internal flag indicating this situation may be set. The "wet alarm" signal is characterized by a relatively low frequency signal, preferably an 8 Hz signal. If, at step 346 the child unit 100 does not detect submergence in water, the unit enters a pause state at step 376 and waits for the next time marker "T" to occur. When the child unit 100 detects the next time marker "T", it transmits for a period "Tx" (100 mS) to the guardian unit 200 status information, including notification that the unit was submerged in water, if in fact it was, and its address at step 378. The child unit 100 then waits for data from the guardian unit 200 at step 380 for a period of "Tr" seconds, preferably approximately 150 mS; if no data is received at step 382 after "Tr" seconds has elapsed, the child unit 100 returns to step 346. If data has been received at step 382, the child unit 100 compares the address of the incoming data to the address stored in memory at step 314. If the addresses match, the child unit 100 loops to step 328 and continues to monitor the status of the wearer; if the addresses do not match, the unit loops to step 346.

Returning now to step 334, if the child unit 100 is not out of range, i.e. it has not received a "come back" request from the guardian unit 200, it determines whether it has been submerged in water at step 340 by sensing the status of switch 32. If the unit is wet, the buzzer 46 sounds an alarm and a flag is set in the microprocessor 30 indicating a wet condition. If the child unit 100 has not detected a submerged condition at step 340, all alarm flags currently stored in the microprocessor 30 are cleared at step 342. At step 350, the child unit 100 determines if an incoming signal is a "monitor" command, which may cause the unit to activate the microphone 44 and enter the monitor mode at step 356. If the received signal is not a "monitor" command, the child unit 100 determines whether a "test" command has been sent by the guardian unit 200 at step 352.

When a "test" command is received, the child unit 100 transmits a test signal to the guardian unit 200 at a test frequency of approximately 1 KHz at step 354. The child unit 100 then waits for the next occurrence of time marker "T" at step 358 before transmitting status information, including its address, to the guardian unit 200. At step 362, the child unit waits "Tr" (150 mS) seconds to receive a response from the guardian unit 200. If no response is received within "Tr" seconds, as determined at step 364, the child unit 100 loops at step 368 to step 340. If a signal is received within "Tr" seconds, the child unit 100 determines whether the response contains the correct address at step 366; a correct address causing the child unit 100 to return to step 328 and an incorrect address causes the child unit 100 to jump to step 368. At step 352, if a "test" command has not been received by the child unit 100, the child unit 100 returns to step 376 and follows the sequence described above.

If the child unit 100 switches to "battery backup", as indicated at step 370, the child unit 100 clears all alerts at step 372, sets time marker "T" at step 374, and continues as described above at step 376. A "battery backup" at step 370 is distinguished from a "change battery", which occurs at step 302, in that a new address is generated by the guardian unit 200 and established between the child and guardian units 100, 200 for the a change battery, while a battery backup uses the address previously stored in memory at step 314.

Referring next to the flowchart of FIG. 6, the power-up and steady state operation of the guardian unit 200 will now be discussed in detail. In general, during power-up, the guardian unit 200 initiates a "handshake" with the child unit 100 to establish a unique sixteen-bit address for communication between the units. This address is included in all signals transmitted between the units to allow them to distinguish transmissions intended for them from transmissions originating from and intended for other similarly configured units. The guardian unit 200 also monitors the distance between the units and sets an alarm at the guardian unit 200 and transmits a call, test or monitor command to the child unit 100 based on input from the guardian wearer, i.e. based upon selective depression of switches 232, 234.

Figure 6:
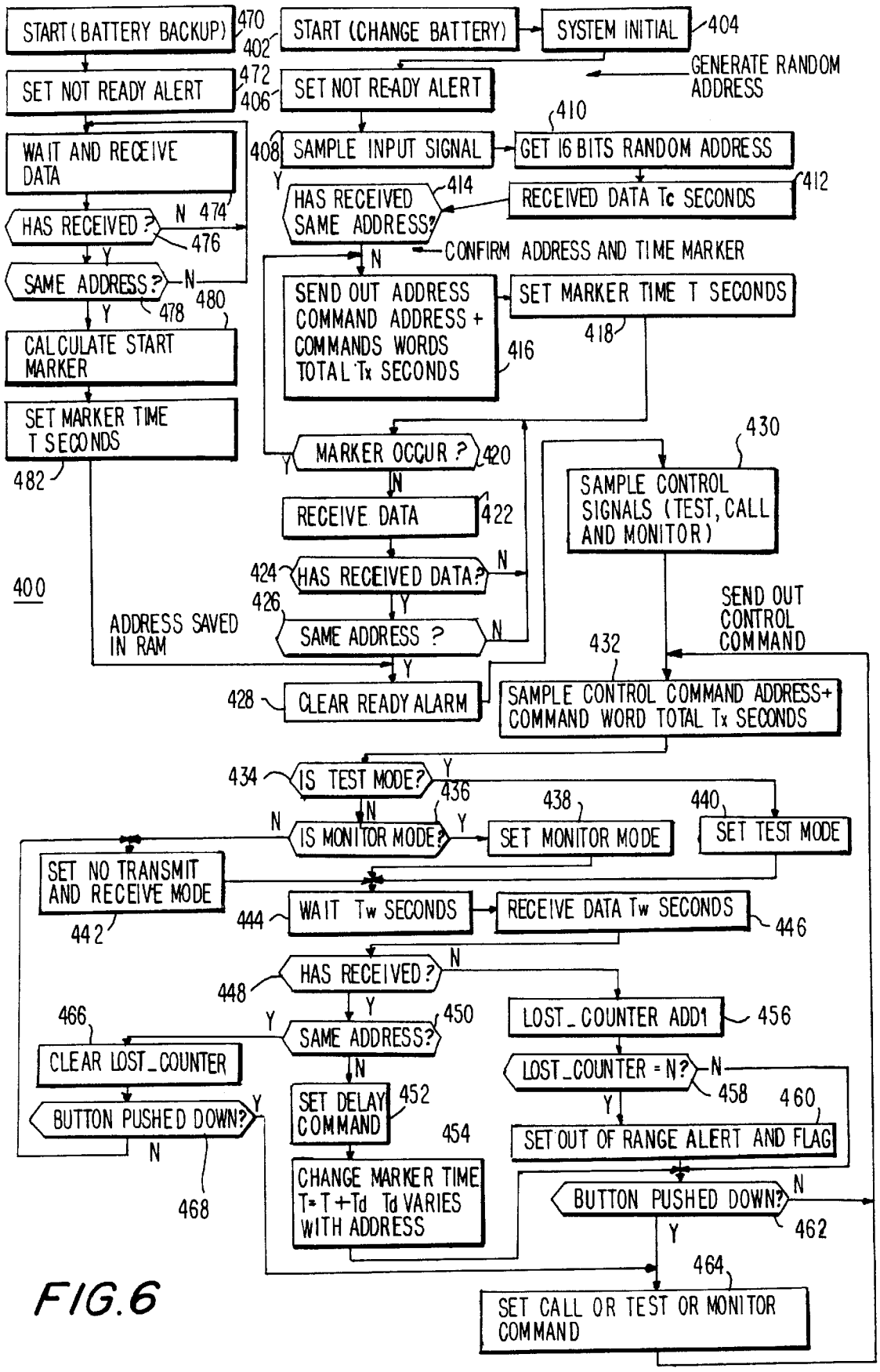
FIG. 6 is a flowchart of the operation of the guardian unit of FIG. 2.

With continued reference to FIG. 6, upon power-up or if the battery in the unit is changed at step 402, the guardian unit 200 performs firmware resident preliminary configuration, e.g. flush memory, etc., including generating the random address at step 404. At step 406, the guardian unit 200 sets an internal "not ready" flag to indicate that the handshake with the child unit 100 has not been completed and the two units have not yet "agreed" on an address. This flag is cleared after the address has been set (see step 428). At step 410, the guardian unit 200 retrieves the newly generated 16-bit random address from memory and beings to sample received data every "Tc" seconds, as indicated at step 412. In a preferred embodiment, "Tc" is approximately equal to two seconds.

In the event the received data contains the same address as that generated by the guardian unit 200, it is likely that a similarly configured unit is operating in the vicinity and transmitting using the same 16-bit address. In this case, a crash has been detected with the other similarly configured unit and the guardian unit 200 must generate a new 16-bit address, as shown at step 414. If the guardian unit 200 has received a signal with an address that does not match the one generated by the guardian unit 200 at step 410, the guardian unit 200 transmits an address command plus command words at step 416 for a duration of "Tx", which is preferably set to approximately 100 mS. Thereafter, the guardian unit 200 sets the time marker "T" at step 418 to indicate the beginning of its transmit and receive periods and to synchronize it with the transmit and receive periods of the child unit 100, i.e. the time marker "T" being set by the guardian unit 200 to coincide with the reception by the guardian unit 200 of a signal from the child unit 100.

If time marker "T" has occurred (step 420), the guardian unit 200 returns to step 416 to retransmit an address plus command code. If time marker "T" has not occurred at step 420, the guardian unit 200 checks whether data has been received at step 424 and loops back to step 420 to wait for the next time marker "T" if no data has been received. If the guardian unit 200 has received data at step 424, the unit checks the address of the received data at step 426 to determine whether the received data is associated with the correct address stored in the guardian unit memory. An incorrect address denotes that the data was not from the corresponding child unit 100, in which case the guardian unit 200 returns to step 420 and continues to monitor the time marker "T" and the received data. If the data received at step 424 contains the correct address, i.e. an address that matches the address of the guardian unit, the guardian and child units 200, 100 have "agreed" on an address and are now ready to begin steady-state operation. The guardian unit 200 clears its internal not ready flag at step 428 and the initiatory handshake between the guardian and child units 200, 100 is now complete.

In "steady-state" operation, the guardian unit 200 continuously samples switches 232 and 234 and transmits control commands and address data to the child unit 100 to monitor the relative position of the units and to monitor the status of the child monitor, i.e. whether the guardian desires to monitor the child's surrounding, to transmit a come back command or to test the relative distance between the units (steps 430 and 432). If the guardian has initiated a test command, as determined at step 434, the guardian unit 200 enters a test mode at step 440. If the guardian has initiated a monitor command by simultaneously depressing switches 232 and 234 and as determined at step 436, the guardian unit 200 disables its transmitter and enters a monitor mode at step 442 where the guardian is able to listen to the ambient noise at the child unit 100 through the guardian unit speaker 246. Regardless of whether a test command or monitor command has been transmitted, the guardian unit 200 then waits "Tw" seconds to receive the next transmission from the child unit 100 (step 444), "Tx" preferably being set to approximately 150 mS.

If, at step 448, no data has been received after "Tw" seconds, the guardian unit 200 increases a "lost" counter at step 456 to monitor the amount of time that data is not received from the child unit 100. Once the "lost" counter reaches a preset number, as determined at step 458, the guardian unit 200 transmits an "out of range" alert to the child unit 100 and sets an internal flag at step 460. In a preferred embodiment, an "out of range" alert may be set when the "lost" counter reaches a maximum count of 4, i.e. when the guardian unit 200 fails to receive a transmission from the child unit 100 for four (4) successive occurrences of time marker "T".

If neither the call nor display switches 232, 234 are depressed on the guardian unit 200, as determined at step 462, indicating that a "come back" command has been transmitted or that the guardian unit 200 is checking the distance between the units, the guardian unit 200 loops to step 432 and transmits a signal comprising an address plus command. If either or both of the switches 232, 234 are depressed, the guardian unit 200 sets a call, test, or monitor command at step 464, depending on which button(s) is/are depressed, and returns to step 432.

Figure 7:
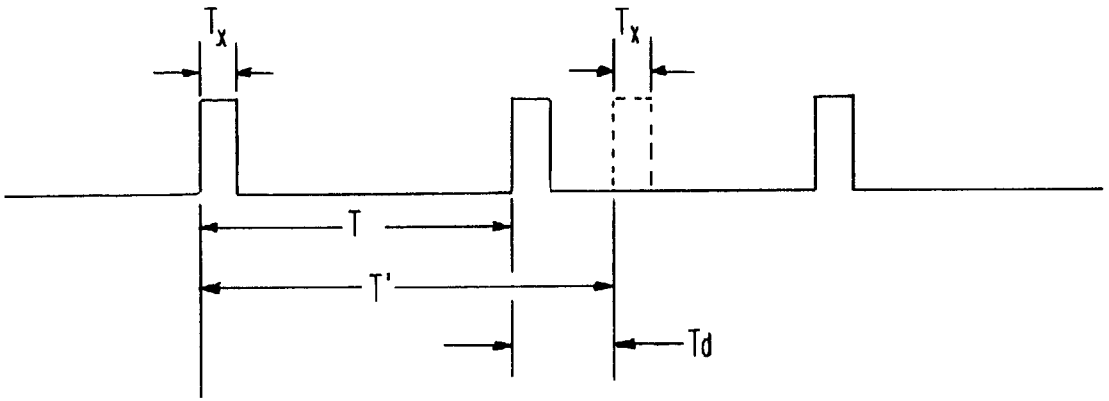
FIG. 7 is a timing diagram illustrating the transmit and receive time period of the child and guardian units of the present invention.

In step 448, once a transmission is received, the guardian unit 200 compares the address of the received signal with its stored sixteen-bit address at step 450. If the addresses agree, the received transmission is from the corresponding child unit 100 and the guardian unit 200 clears the "lost" counter at step 446. If the received transmission contains a different address, it indicates that a similarly configured unit may be operating in the vicinity and using the same time marker "T". It is therefore necessary to offset the time marker "T" for the guardian/child unit pair to avoid the possibility of transmission jamming among the units, i.e. an inability to communicate between corresponding child and guardian units 100, 200. To accomplish this, the guardian unit 200 sets a delay command at step 452 for transmission to the child unit 100 to increase the duration between occurrences of time marker "T" by a predetermined delay period "Td". The delay period "Td" varies with each randomly generated address and is combined with initial time marker "T" to generate a new time marker "T", as shown in FIG. 7.

If the signal received at step 448 includes an address part that matches the address stored in the guardian unit's memory, the "lost" counter is cleared at step 466 and the status of the switches is checked at step 468. If none of the switches are depressed, the guardian unit 200 returns to step 436; if any switch is depressed, the guardian unit 200 loops to step 464.

An alternative power-up sequence is followed by the guardian unit 200 when it switches to a battery back-up mode, beginning at step 470. In this case, the guardian unit 200 does not generate a new random address but, instead, uses the address stored during its initial power-up sequence, see e.g. steps 402–426. The guardian unit 200 initially enters a receive mode, waiting for a transmission from the corresponding child unit 100, i.e. a transmission having a matching address. During either start-up sequence, i.e. change battery (step 402) or battery backup (step 470), the child unit 100 arbitrarily selects the point at which transmission will begin. Consequently, the guardian unit 200 "listens" until it receives a matching signal and then marks the point at which such a signal is received. The guardian unit 200 is then able to set the time marker "T" as the subsequent time at which transmission from the corresponding child unit 100 should be forthcoming.

In operation, the child unit 100 continuously transmits its address to the guardian unit 200 upon every occurrence of time marker "T". If the guardian unit 200 fails to receive a transmission at successive occurrences of "T", it counts such occurrences and activates an "out of range" alarm at the guardian unit 200 when the counter exceeds a preset limit, preferably 4. The guardian unit 200 also tries to automatically recover when communication from the child unit 100 is not received. The guardian unit 200 can also fail to receive transmissions from the child unit 100 if other similarly configured devices are transmitting at time marks "T" that are separated by less than "Tx", i.e. the transmissions occur approximately every "T" seconds, last "Tx" seconds, and overlap each other jamming the receiving guardian unit 200. The guardian unit 200 detects this condition by a failure to receive a transmission from the child unit 100 without an out of range alarm being triggered. Under these circumstances, the guardian unit 200 can remotely establish a new time marker "T" which extends the previously established mark by at least delay period "Td" (see FIG. 7). Accordingly, the new time marker "T'" lasts at least "Td" seconds longer than the previously established time marker "T". Jamming is thereby avoided for proximately located child/guardian pairs transmitting at the same frequency.

The guardian unit 200 can also fail to receive transmissions when the child unit 100 is out of range or out of sight. An out of range condition exists when the child unit 100 is located physically beyond the maximum range as set by switch 272 of the guardian unit 200. In addition, the 900 MHz frequency band is advantageously characterized by its strong directional requirements and high attenuation when a signal source is obstructed. Such characteristics are desirable for an application such as the present invention because an out of range condition also exists if the child unit 100 is within the 150 feet maximum separation range but merely around a corner or otherwise out of sight. Here too, the guardian unit 200 detects the alarm condition by a failure to receive signals from the child unit 100 for four (4) successive occurrences of "T" (or "T'") and attempts to remedy the situation by sending an alarm signal to the child unit 100 and by attempting to remotely reconnect the units.

According to a preferred embodiment of the present invention, twenty identical guardian/child units 100, 200 may operate in the same 75-foot radial area without the typically unavoidable and undesirable jamming of the various units due to simultaneous use of the same operating frequency.

The present invention thus provides a child monitoring and location device having a channel scanning feature wherein each of the guardian and child units 200, 100 are capable of operating at one of a plurality of frequency channels with a preset frequency band. Consequently, interference from other electronic devices in the vicinity can be avoided. Upon power-up, the guardian and conduct an electronic "handshake" to select an operating frequency channel. If the selected channel is being used by another electronic device in the vicinity, both the guardian and child units 200, 100 will sound an alarm, indicating that the power-up sequence must be re-initiated, i.e. the units must be turned off and then on again. This process is repeated until the units "agree" on an operating frequency which is currently not in use in the vicinity of the units.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. It is the intention, therefore, to be limited only as indicated by the scope of the claims appended hereto.

What is claimed is:

1. A device for providing direct wireless communication between a child and a guardian in an environment while avoiding interference present from other wireless devices operating in the environment, comprising:

a guardian monitor for transmitting and receiving wireless signals having frequencies above 900 MHz, said guardian monitor having an address generator for generating a random address and a memory for storing the generated random address, means for setting a first time marker and for communicating a signal comprising said generated random address from said guardian monitor and for detecting every occurrence of said first time marker;

a child monitor for transmitting and receiving wireless signals having frequencies above 900 MHz for communication with said guardian monitor, said child monitor having means for receiving a signal comprising said random address generated by said guardian monitor and a memory for storing said generated random address, means for detecting every occurrence of said first time marker, means for communicating a signal comprising the received random address back to said guardian monitor upon every occurrence of said first time marker;

means in said guardian monitor for confirming that the address part of the signal communicated back from said child monitor corresponds to the address part of the signal communicated to said child monitor by said guardian monitor;

means in said guardian monitor for setting a second time marker that is shifted from said first time marker by a predetermined time period, means for communicating said second time marker from said guardian monitor and for detecting every occurrence of said second time marker;

means in said child monitor for receiving said second time marker generated by said guardian monitor, means for detecting every occurrence of said second time marker, means for communicating a signal comprising said received random address back to the guardian monitor upon every occurrence of said second time marker;

each of said child monitor and said guardian monitor further comprising means for storing said generated random address and said first and said second time markers in the memories of said respective monitors upon confirmation by said guardian monitor confirming means that the address communicated back from said child monitor corresponds to the address communicated to said child monitor by said guardian monitor; and each of said guardian monitor and said child monitor further comprising means for transmitting wireless signals to and for receiving from the other of said guardian monitor and said child monitor wireless signals incorporating a reference to the stored address so that the one of said guardian monitor and child monitor receiving said wireless signals is operable to compare the incorporated reference and the address stored in said memory of the one of said guardian monitor and child monitor to confirm that the received wireless signal is intended for receipt by said one of the guardian monitor and child monitor.

2. The device of claim 1, wherein said first time marker occurs approximately every one second.

3. The device of claim 2, wherein each of said guardian monitor and said child monitor transmit a wireless signal comprising said generated random address upon every occurrence of said first time marker for a duration of approximately 100 milliseconds.

4. The device of claim 1, wherein said confirming means in said guardian unit comprises a microprocessor.

5. The device of claim 1, wherein said signal communicated by said guardian unit further comprises a command part.

6. The device of claim 1, wherein said first time marker is set by said guardian unit to approximately coincide with the reception by said guardian unit of said signal communicated by said child unit.

7. The device of claim 1, wherein said transmitting and receiving means in each of said guardian monitor and said child monitor comprises an antenna and a local oscillator integral to each of said guardian monitor and child monitor.

8. The device of claim 1, wherein each of said guardian monitor and said child monitor transmit a wireless signal comprising said generated random address for a predetermined duration.

9. The device of claim 8, wherein said predetermined time period by which said second time marker is shifted from said first time marker is approximately greater than said predetermined transmission duration.

10. The device of claim 8, wherein said predetermined time period by which said second time marker is shifted from said first time marker is approximately equal to 100 milliseconds.

* * * * *